United States Patent [19]

Krieg et al.

[11] Patent Number: 4,974,425

[45] Date of Patent: Dec. 4, 1990

[54] CLOSED CRYOGENIC BARRIER FOR CONTAINMENT OF HAZARDOUS MATERIAL MIGRATION IN THE EARTH

[75] Inventors: Ronald K. Krieg, Blaine; John A. Drumheller, Issaquah, both of Wash.

[73] Assignee: Concept RKK, Limited, Bellevue, Wash.

[21] Appl. No.: 392,941

[22] Filed: Aug. 16, 1989

Related U.S. Application Data

[63] Continuation-in-part of Ser. No. 281,493, Dec. 8, 1988, Pat. No. 4,860,544.

[51] Int. Cl.[5] ..... F17C 1/00

[52] U.S. Cl. ..... 62/45.1; 62/260; 165/45; 405/56; 405/130; 405/270

[58] Field of Search ..... 62/45.1, 260; 165/45; 405/56, 130, 270

[56] References Cited

U.S. PATENT DOCUMENTS

| | | | |
|---|---|---|---|
| 907,441 | 12/1908 | Baur | 405/130 |
| 2,159,954 | 5/1939 | Powell | 405/270 |
| 2,865,177 | 12/1958 | Guaedinger | 61/36 |
| 3,183,675 | 5/1965 | Schroeder | 405/130 |
| 3,267,680 | 8/1966 | Schlumberger | 405/130 |
| 3,295,328 | 1/1967 | Bishop | 405/56 |
| 3,350,888 | 11/1967 | Shrier | 61/36 |
| 3,354,654 | 11/1967 | Vignovich | 62/260 |
| 3,559,737 | 2/1971 | Ralstin et al. | 405/56 |
| 3,707,850 | 1/1973 | Connell et al. | 62/45 |
| 3,915,727 | 10/1975 | Sparlin et al. | 106/123 |
| 3,934,420 | 1/1976 | Janelid et al. | 405/269 |
| 4,030,307 | 6/1977 | Avedisian | 405/270 |
| 4,439,062 | 3/1984 | Kingsbury | 405/270 |
| 4,597,444 | 7/1986 | Hutchinson | 166/302 |
| 4,607,488 | 8/1986 | Karinthi et al. | 62/260 |
| 4,632,604 | 12/1986 | McKelvy | 405/217 |
| 4,637,462 | 1/1987 | Grable | 405/270 |
| 4,723,876 | 2/1988 | Spalding et al. | 405/225 |

*Primary Examiner*—Ronald C. Capossela
*Attorney, Agent, or Firm*—Lahive & Cockfield

[57] ABSTRACT

A method and system is disclosed for reversibly establishing a closed, flow-impervious cryogenic barrier about a predetermined volume extending downward from a containment site on the surface of the Earth. An array of barrier boreholes extend downward from spaced apart locations on the periphery of the containment site. A flow of a refrigent medium is established in the barrier boreholes whereby water in the portions of the Earth adjacent to the barrier boreholes freezes to established ice columns extending radially about the boreholes. The lateral separations of the boreholes and the radii of the ice columns are selected so that adjacent ice columns overlap. The overlapping ice columns collectively establish a closed, flow-impervious barrier about the predetermined volume underlying the containment site. The system may detect and correct potential breaches due to thermal, geophysical, or chemical invasions.

24 Claims, 4 Drawing Sheets

CLOSED CRYOGENIC BARRIER FOR CONTAINMENT OF HAZARDOUS MATERIAL MIGRATION IN THE EARTH

REFERENCE TO RELATED APPLICATION

The present application is a continuation-in-part of U.S. Ser. No. 281,493, filed Dec. 8, 1988, U.S. Pat. No. 4860544 "Closed Cryogenic Barrier for Containment of Hazardous Material Migration in the Earth".

BACKGROUND OF THE DISCLOSURE

The present invention is in the field of hazardous waste control and more particularly relates to the control and reliable containment of flow of materials in the Earth.

Toxic substance migration in the Earth poses an increasing threat to the environment, and particularly to ground water supplies. Such toxic substance migration may originate from a number of sources, such as surface spills (e.g., oil, gasoline, pesticides, and the like), discarded chemicals (e.g., PCB's, heavy metals), nuclear accident and nuclear waste (e.g., radioactive isotopes, such as strontium 90, uranium 235), and commercial and residential waste (e.g., PCB's, solvents, methane gas). The entry of such hazardous materials into the ecosystem, and particularly the aquifer system, is well known to result in serious health problems for the general populace.

In recognition of such problems, there have been increasing efforts by both private environmental protection groups and governmental agencies, which taken together with increasing governmentally imposed restrictions on the disposal and use of toxic materials, to address the problem of long term, or permanent, safe storage of hazardous wastes, and to clean up existing hazardous waste sites.

Conventional long term hazardous material storage techniques include the use of sealed containers located in underground "vaults" formed in rock formations, or storage sites lined with fluid flow-"impervious" layers, such as may be formed by crushed shale or bentonite slurries. By way of example, U.S. Pat. No. 4,637,462 discloses a method of containing contaminants by injecting a bentonite/clay slurry or "mud" into boreholes in the Earth to form a barrier ring intended to limit the lateral flow of contaminants from a storage site.

Among the other prior art approaches, U.S. Pat. No. 3,934,420 discloses an approach for sealing cracks in walls of a rock chamber for storing a medium which is colder than the chamber walls. U.S. Pat. No. 2,159,954 discloses the use of bentonite to impede and control the flow of water in underground channels and pervious strata. U.S. Pat. No. 4,030,307 also discloses a liquid-"impermeable" geologic barrier, which is constructed from a compacted crushed shale. Similarly, U.S. Pat. No. 4,439,062 discloses a sealing system for an earthen container from a water expandable colloidal clay, such as bentonite.

It is also known to form storage reservoirs from frozen earthen walls disposed laterally about the material to-be-stored, such as liquified gas. See, for example, U.S. Pat. Nos. 3,267,680 and 3,183,675.

While all of such techniques do to some degree provide a limitation to the migration of materials in the Earth, none effectively provide long term, reliable containment of hazardous waste. The clay, shale and bentonite slurry and rock sealant approaches, in particular, are susceptible to failure by fracture in the event of earthquakes or other Earth movement phenomena. The frozen wall reservoir approaches do not address long term storage at all and fail to completely encompass the materials being stored. None of the prior art techniques address monitoring of the integrity of containment systems or of conditions that might lead to breach of integrity, or the correction of detected breaches of integrity.

Existing hazardous waste sites present a different problem. Many of them were constructed with little or no attempt to contain leakage; for example, municipal landfills placed in abandoned gravel pits. Furthermore, containment must either be in situ, or else the entire site must be excavated and moved. The primary current technology for in situ containment is to install slurry walls. However, that technique allows leaks under the wall; and through the wall when it cracks. Furthermore, slurry walls can only be installed successfully in a limited number of soil and rock conditions. Perhaps most importantly, there is no way to monitor when a slurry wall has bee breached, nor is there any known economical means to fix such a breach.

Another practical and legislatively required factor in the provision of effective toxic material containment, is the need to be able to remove a containment system. None of the prior art systems permit economic removal of the system once it is in place.

Accordingly, it is an object of the present invention to provide an improved hazardous waste containment method and system.

Another object is to provide an improved hazardous waste containment method and system that is effective over a long term.

Yet another object is to provide an improved hazardous waste containment method and system that is economic and efficient to install and operate.

Still another object is to provide an improved hazardous waste containment method and system that may be readily removed.

It is another object to provide an improved hazardous waste containment method and system that permits integrity monitoring and correction of potential short term failures before they actually occur.

It is yet another object to provide an improved hazardous waste containment method and system that is self-healing in the event of seismic events or Earth movement.

SUMMARY OF THE INVENTION

The present invention is a method and system for reversibly establishing a closed cryogenic barrier confinement system about a predetermined volume extending downward from or beneath a surface region of the Earth, i.e., a containment site. The confinement system is installed at the containment site by initially establishing an array of barrier boreholes extending downward from spaced-apart locations on the periphery of the containment site. Then, a flow of refrigerant is established in the barrier boreholes. In response to the refrigerant flow in the barrier boreholes, the water in the portions of the Earth adjacent to those boreholes freezes to establish ice columns extending radially about the central axes of the boreholes. During the initial freeze-down, the amount of heat extracted by the refrigerant flow is controlled so that the radii of the ice columns increase until adjacent columns overlap. The overlapping columns collectively establish a closed barrier about the volume underlying the containment site. After the barrier is established, a lesser flow of refrigerant is generally used to maintain the overlapping relationship of the adjacent ice columns.

The ice column barrier provides a substantially fully impervious wall to fluid and gas flow due to the migration characteristics of materials through ice. In the event of loss of refrigerant in the barrier boreholes, heat flow characteristics of the Earth are such that ice column integrity may be maintained for substantial periods, typically six to twelve months for a single barrier, and one to two years for double barrier. Moreover, the ice column barrier is "self-healing" with respect to fractures since adjacent ice surfaces will fuse due to the opposing pressure from the overburden, thereby re-establishing a continuous ice wall. The barrier may be readily removed, as desired, by reducing or eliminating the refrigerant flow, or by establishing a relatively warm flow in the barrier boreholes, so that the ice columns melt. The liquid phase water (which may be contaminated), resulting from ice column melting, may be removed from the injection boreholes by pumping.

In some forms of the invention, depending on sub-surface conditions at the containment site, water may be injected into selected portions of the Earth adjacent to the barrier boreholes prior to establishing the refrigerant flow in those boreholes.

Where there is sub-surface water flow adjacent to the barrier boreholes prior to establishing the ice columns, that flow is preferably eliminated or reduced prior to the initial freeze-down. By way of example, that flow may be controlled by injecting material in the flow-bearing portions of the Earth adjacent to the boreholes, "upriver" side first. The injected material may, for example, be selected from the group consisting of bentonite, starch, grain, cereal, silicate, and particulate rock. The degree of control is an economic trade-off with the cost of the follow-on maintenance refrigeration required.

In some forms of the invention, the barrier boreholes are established (for example, by slant or curve drilling techniques) so that the overlapping ice columns collectively establish a barrier fully enclosing the predetermined volume underlying the containment site.

Alternatively, where a substantially fluid impervious sub surface region of the Earth is identified as underlying the predetermined volume, the barrier boreholes may be established in a "picket fence" type configuration between the surface of the Earth and the impervious sub-surface region. In the latter configuration, the overlapping ice columns and the sub-surface impervious region collectively establish a barrier fully enclosing the predetermined volume underlying the containment site.

The containment system of the invention may further include one or more fluid impervious outer barriers displaced outwardly from the overlapping ice columns established about the barrier boreholes.

The outer barriers may each be installed by initially establishing an array of outer boreholes extending downward from spaced-apart locations on the outer periphery of a substantially annular, or circumferential, surface region surrounding the containment site.

A flow of a refrigerant is then established in these outer boreholes, whereby the water in the portions of the Earth adjacent to the outer boreholes freezes to establish ice columns extending radially about the central axes of the outer boreholes. The radii of the columns and the lateral separations of the outer boreholes are selected so that adjacent columns overlap, and those overlapping columns collectively establish the outer barrier. The region between inner and outer barriers would normally be allowed to freeze over time, to form a single composite, relatively thick barrier.

In general, refrigerant medium flowing in the barrier boreholes is characterized by a temperature T1 wherein T1 is below 0° Celsius. By way of example, the refrigerant medium may be brine at −10° Celsius, or ammonia at −25° Celsius, or liquid nitrogen at −200° Celsius.

The choice of which refrigerant medium to use is dictated by a number of conflicting design criteria. For example, brine is the cheapest but is corrosive and has a high freezing point. Thus, brine is appropriate only when the containment is to be short term and the contaminants and soils involved do not require abnormally cold ice to remain solid. For example, some clays require −15° Celsius to freeze. Ammonia is an industry standard, but is sufficiently toxic so that its use is contraindicated if the site is near a populace. The Freons are in general ideal, but are expensive. Liquid nitrogen allows a fast freezedown in emergency containment cases, but is expensive and requires special casings in the boreholes used.

In confinement systems where outer barriers are also used, the refrigerant medium flowing in the outer boreholes is characterized by a temperature T2, wherein T2 is below 0° Celsius. In some embodiments, the refrigerant medium may be the same in the barrier boreholes and outer boreholes and T1 may equal T2. In other embodiments, the refrigerant media for the respective sets of boreholes may differ and T2 may differ from T1. For example, T1 may represent the "emergency" use of liquid nitrogen at a particularly hazardous spill site.

In various forms of the invention, the integrity of said overlapping ice columns may be monitored (on a continuous or sampled basis), so that breaches of integrity, or conditions leading to breaches of integrity, may be detected and corrected before the escape of materials from the volume underlying the containment site. The integrity monitoring may include monitoring the temperature at a predetermined set of locations with or adjacent to the ice columns, for example, through the use of an array of infra-red sensors and/or thermocouples or other sensors. In addition, or alternatively, a set of radiation detectors may be used to sense the presence of radioactive materials.

The detected parameters for the respective sensors may be analyzed to identify portions of the overlapping columns subject to conditions leading to lack of integrity of those columns, such as may be caused by chemically or biologically generated "hot" spots, external underground water flow, or abnormal surface air ambient temperatures. With this gas pressure test, for example, it may be determined whether chemical invasion from inside the barrier has occurred, heat invasion from outside the barrier has occurred, or whether earth movement cracking has been healed.

In response to such detection, the flow of refrigerant in the barrier boreholes is modified whereby additional heat is extracted from those identified portions, and the ice columns are maintained in their fully overlapping state.

Ice column integrity may also be monitored by establishing injection boreholes extending downward from locations adjacent to selected ones of the barrier boreholes. In some configurations, these injection boreholes may be used directly or they may be lined with water permeable tubular casings.

To monitor the ice column integrity, prior to establishing the refrigerant flow, the injection boreholes are reversibly filled, for example, by insertion of a solid core. Then, after the initial freeze-down at the barrier boreholes, the fill is removed from the injection boreholes and a gaseous medium is pumped into those boreholes. The steady-state gas flow rate is then monitored. When the steady-state gas flow rate into one of the injection boreholes is above a predetermined threshold, then a lack of integrity condition is indicated. The ice columns are characterized by integrity otherwise. With this gas pressure test, for example, it may be determined whether chemical invasion from inside the barrier has occurred, heat invasion from outside the barrier has occurred, or whether earth movement cracking has been healed.

When the barrier is first formed, this gas pressure test is used to confirm that the barrier is complete. Specifically, the overlapping of the ice columns is tested, and the lack of any "voids" due to insufficient water content is tested. Later, this gas pressure test is used to ensure that the barrier has not melted due to chemical invasion (which will not be detectable in general by the temperature monitoring system), particularly by solvents such as DMSO. Injection boreholes placed inside and outside the barrier boreholes can also be used to monitor the thickness of the barrier.

A detected lack of integrity of the overlapping ice columns may be readily corrected by first identifying one of the injection boreholes for which said gas flow rate is indicative of lack of integrity of the overlapping ice columns, and then injecting hot water into the identified injection borehole. The hot water (which may be in liquid phase or gas phase) fills the breach in the ice columns and freezes to seal that breach.

Alternatively, a detected lack of integrity may be corrected by pumping liquid phase materials from the injection boreholes, so that a concentration of a breach-causing material is removed. A detected lack of integrity may also be corrected by modifying the flow of refrigerant in the barrier boreholes so that additional heat is extracted from the columns characterized by lack of integrity.

In most prior usage of ground freezing, there has been strong economic incentive to freeze down the Earth quickly; for example, to allow construction of a building, dam, or tunnel to proceed. However, in the case of hazardous waste containment, the usual problem is the concern that the underground aquifer will eventually be contaminated, but the problem is not immediate. Significant economic savings can be obtained by allowing the initial freezedown to take a year or so to occur, since the efficiency of the refrigeration process goes up significantly the slower the process is applied. In particular, the maintenance refrigeration equipment can be used to effect the freezedown rather than the usual practice of leasing special heavy duty refrigeration equipment in addition to the maintenance equipment.

If the installation is anticipated to be long-term, typically in excess of ten years, then several modifications will be considered.

First, the confinement system may be made fully or partially energy self-sufficient through the use of solar power generators positioned at or near the containment site, where the generators produce and store, as needed, energy necessary to power the various elements of the system. The match between the technologies is good, because during the day the electricity can be sold to the grid during peak demand, and at night during off-peak demand power can be brought back to drive the refrigeration units when the refrigeration process is most efficient.

Second, the compressor system may be replaced with a solid-state thermoelectric or magneto-caloric system, thereby trading current capital cost for long term reliability and significantly lower equipment maintenance.

Third, the freezing boreholes may be connected to the refrigeration units via a "sliding manifold" whereby any one borehole can be switched to any of a plurality of refrigeration units; thereby permitting another level of "failsafe" operation.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
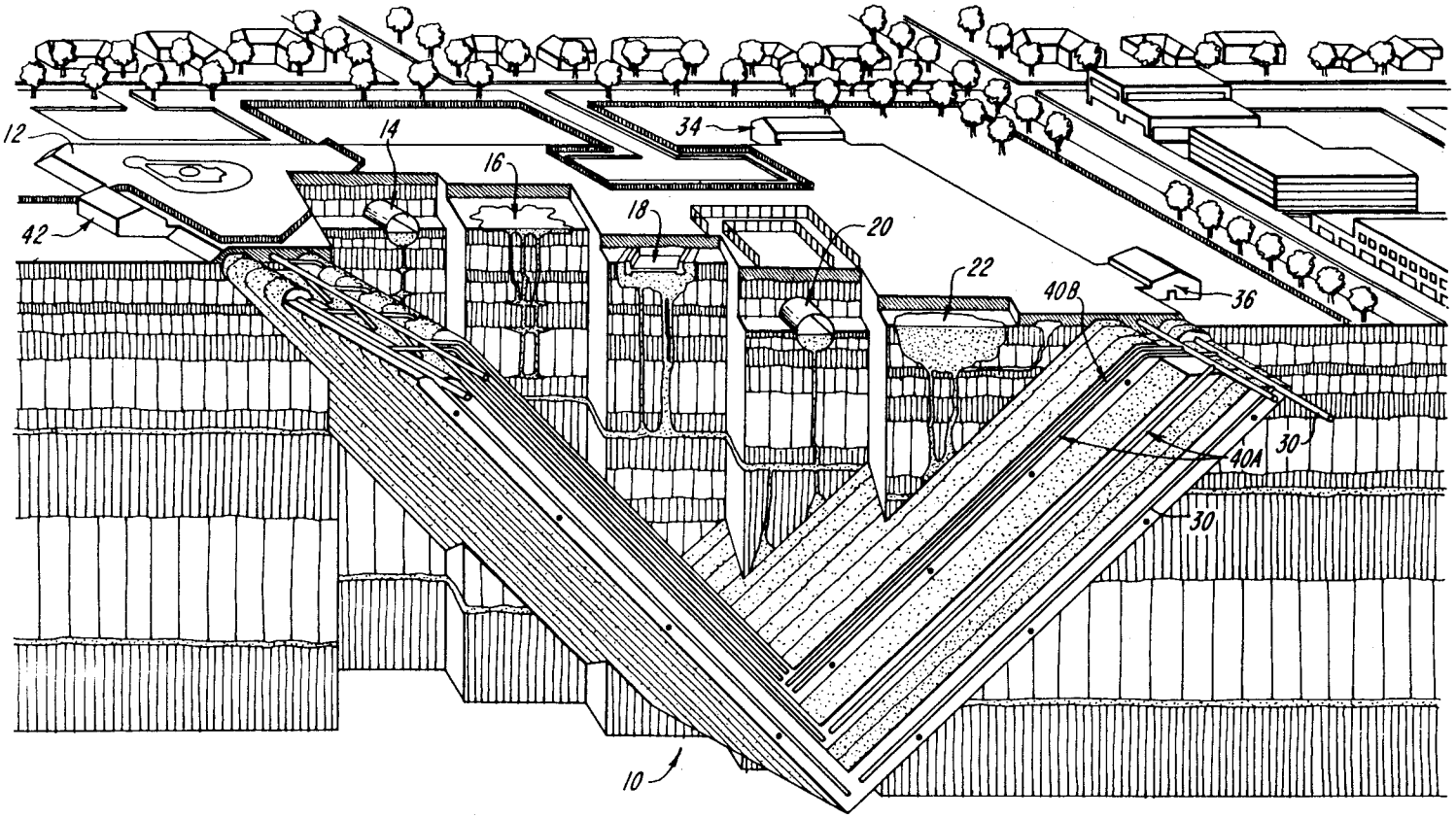
FIG. 1 shows a cut-away schematic representation of a confinement system in accordance with the present invention.

A cryogenic barrier confinement system 10 embodying the invention is shown in FIG. 1. In that figure, a containment surface region of the Earth is shown bearing a soil Cap layer 12 overlying deposits of hazardous waste material. In the illustrated embodiment, these deposits are represented by a leaking gas storage tank 14, a surface spill 16 (for example, gasoline, oil, pesticides), an abandoned chemical plant 18 (which, for example, may leak materials such as PCB's or DDT), a leaking nuclear material storage tank 20 (containing, for example, radioactive isotopes, such as strontium 90 or U-235) and a garbage dump 22 (which, for example, may leak leachite, PCB's and chemicals, and which may produce methane).

The confinement system 10 includes a barrier network 30 having a dual set of (inner and outer) cryogenic fluid pipes extending into the Earth from spaced apart locations about the perimeter of the containment surface underlying soil cap layer 12. In the preferred embodiment, the cap layer 12 is impervious to fluid flow and forms a part of system 10. With such a cap layer the enclosed volume does not overflow due to addition of fluids to the containment site. In the illustrated embodiment, the cryogenic fluid pipes extend such that their distal tips tend to converge at underground locations. In alternative embodiments, for example where there is a fluid flow-impervious sub-stratum underlying the containment site, the cryogenic fluid pipes may not converge, but rather the pipes may extend from spaced apart locations n the perimeter of the containment surface to that sub-stratum, establishing a "picket fence"- like ring of pipes, which together with the fluid flow-impervious sub-stratum, fully enclose a volume underlying the containment surface. In the illustrated embodiment, the cryogenic pipes extend downward from points near or at the Earth's surface. In alternate forms of the invention, these pipes may extend downward from points displaced below the Earth's surface (e.g., by 10–15 feet) so that the resulting barrier forms a cup-like structure to contain fluid flow therein, with a significant saving on maintenance refrigeration costs. In that configuration, fluid level monitors may detect when the cup is near filled, and fluid may be pumped out.

Figure 2:
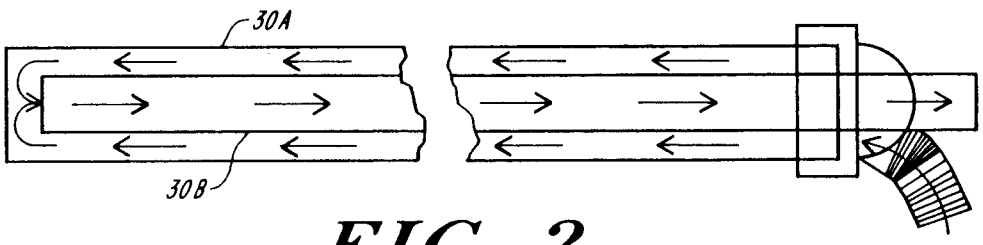
FIG. 2 shows in section, one of the concentric pipe units of the barrier network of the system of FIG. 1.

In the preferred embodiment, each of the pipes of network 30 is a two concentric steel pipe unit of the form shown in FIG. 2. In each unit, where the outer pipe 30A is closed at its distal end and the inner pipe 30B is open at its distal end and is spaced apart from the closed end of the outer pipe.

Two cryogenic pump stations 34 and 36 are coupled to the barrier network 30 in a manner establishing a controlled, closed circuit flow of a refrigerant medium from the pump stations, through the inner conduit of each pipe unit, through the outer conduit of each pipe unit (in the flow directions indicated by the arrows in FIG. 2), and back to the pump station. Each pump station includes a flow rate controller and an associated cooling unit of cooling refrigerant passing therethrough.

The confinement system 10 further includes an injection network 40 of water-permeable injection pipes extending into the Earth between the inner and outer sets of barrier pipes of network 30 (exemplified by pipe 40A in FIG. 1) and adjacent to the pipes of the network 30 (exemplified by pipe 40B in FIG. 1). In other forms of the invention, the pipes of injection network 40 may be replaced by simple boreholes (i.e. without a pipe structure).

A water pumping station 42 is coupled to the injection network 40 in a manner establishing a controlled flow of water into the injection pipes of network 40.

A first set of sensors (represented by solid circles) and a second set of sensors (represented by hollow rectangles) are positioned at various points near the pipes of barrier network 30. By way of example, the sensors of the first set may be thermocouple-based devices and the sensors of the second set may be infrared sensors or, alternatively may be radio-isotope sensors. In addition, a set of elevated infrared sensors are mounted on poles above the containment site. The sub-surface temperature may also be monitored by measuring the differential heat of the inflow-outflow at the barrier boreholes and differential heat flow at the compressor stations.

In order to install the system 10 at the site, following analysis of the site sub-surface conditions, a set of barrier boreholes is first established to house the pipes of network 30. The placement of the barrier boreholes is a design tradeoff between the number of boreholes (in view of cost) and "set-back" between the contaminant-containing regions and the peripheral ring of barrier boreholes. The lower set-back margin permits greater relative economy (in terms of installation and maintenance) and larger set-back permits greater relative safety (permitting biological action to continue and permits use of other mitigation techniques.

The boreholes may be established by conventional vertical, slant or curve drilling techniques to form an array which underlies the surface site. The lateral spacing of the barrier boreholes is determined in view of the moisture content, porosity, chemical, and thermal characteristics of the ground underlying the site, and in view of the temperature and heat transfer characteristics of refrigerant medium to be used in those boreholes and the pipes.

Passive cooling using thermal wicking techniques may be used to extract heat from the center of the site, thus lowering the maintenance refrigeration requirements. In general, such a system consists of a closed refrigerant system consisting of one or more boreholes placed in or near the center of the site connected to a surface radiator via a pump. The pump is turned on whenever the ambiant air is colder than the Earth at the center of the site. If the radiator is properly designed, this system can also be used to expel heat by means of black body radiation to the night sky.

In the illustrated embodiment, sub-surface conditions indicate that addition of water is necessary to provide sufficient moisture so that the desired ice columns may be formed for an effective confinement system. To provide that additional sub-surface water, a set of injection boreholes is established to house the water permeable injection pipes of network 40. The injection boreholes also serve to monitor the integrity of the barrier by means of the afore-described gas pressure test.

Following installation of the networks 30 and 40, the pump station 42 effects a flow of water through the injection pipes of network 40 and into the ground adjacent to those pipes. Then the refrigerant pump stations 34 and 36 effect a flow of the refrigerant medium through the pipes of network 30 to extract heat at a relatively high start-up rate. That refrigerant flow extracts heat from the sub-surface regions adjacent to the pipes to establish radially expanding ice columns about each of the pipes in network 30. This process is continued until the ice columns about adjacent ones of the inner pipes of network 30 overlap to establish an inner closed barrier about the volume beneath the site, and until the ice columns about adjacent ones of the outer pipes of network 30 overlap to form an outer closed barrier about that volume. Then, the refrigerant flow is adjusted to reduce the heat extraction to a steady-state "maintenance" rate sufficient to maintain the columns in place. However, if the "start-up" is slow to enhance the economics and is done in winter, the "maintenance" rate in summer could be higher than the startup rate.

With the barriers established by the overlapping ice columns of system 10, the volume beneath the containment site and bounded by the barrier provides an effective seal to prevent migration of fluid flow from that volume.

With the dual (inner and outer) sets of pipes in network 30 of the illustrated embodiment, the system 10 establishes a dual (inner and outer) barrier for containing the flow of toxic materials.

Figure 5:
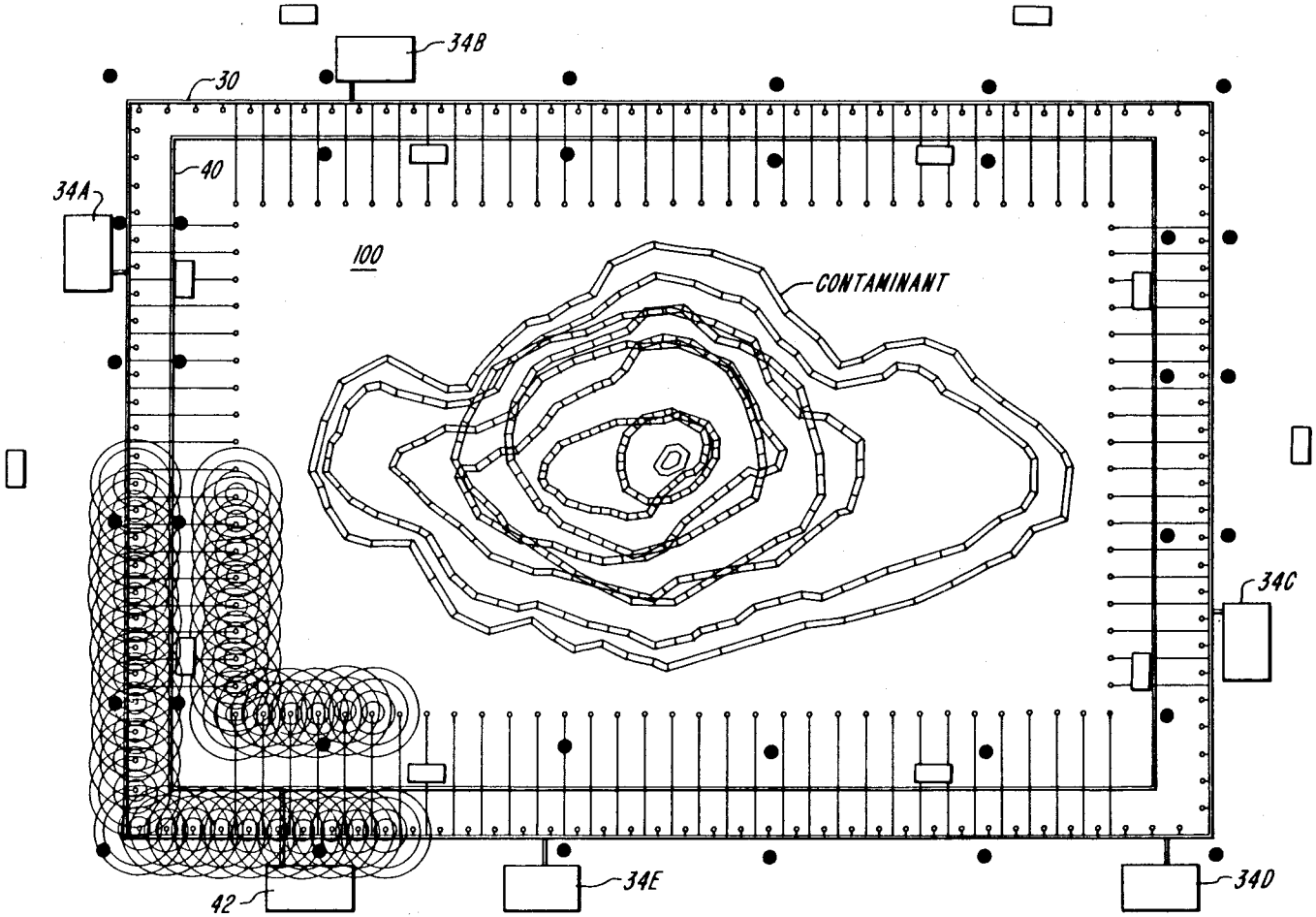
FIG. 5 shows a top elevation view of the cryogenic barrier confinement system of FIG. 4.

The network 30, as shown in FIG. 5, includes a set of barrier boreholes extending downward from locations on the periphery of a rectangular confinement surface region of the Earth, and a set of outer boreholes extending downward from locations on the periphery of rectangle-bounded circumferential surface region surrounding that confinement surface region. The central axes of the boreholes in the illustrated example extend along substantially straight lines. Moreover, the outer boreholes of the principal portions of the set are positioned to be substantially equidistant from the two nearest boreholes of the barrier set, leading to a configuration requiring a minimum of energy to establish the overlapping ice columns forming the respective barriers.

In an alternate configuration, the contiguous boreholes of the barrier set (and of the outer set, in a double barrier configuration) may each extend along the peripheries of the respective surface regions, but with a zig-zag pattern (i.e. alternately on one side and then the other) along the peripheries. Preferably, the extent of zig-zag is less than about ten percent relative to the inter-barrier spacing. With the zig-zag configuration, as the ice columns extend to the point of overlapping, the alternating refrigerant pipes for the respective columns are allowed to be displaced slightly in opposite directions perpendicular to the local portion of the periphery, thereby minimizing stress on those pipes. In contrast, where the pipes are strictly "in line", there may be a high degree of stress placed on the pipes as the columns begin to overlap. With the zig-zag configuration, the respective outer boreholes, as shown, are also considered to be substantially equidistant (except for the relatively minor variance due to the zig-zag) from their two nearest neighbor barrier boreholes.

Other configurations might also be used, such as a single pipe set configuration which establishes a single barrier, or a configuration with three or more sets of parallel pipes to establish multiple barriers. As the number of pipe sets, and thus overlapping ice column barriers, increases, the reliability factor for effective containment increases, particularly by heat invasion from outside. Also, a measure of thermal insulation is attained between the containment volume and points outside that volume. One characteristic of the cryogenic barrier established by the invention is that the central portion (i.e. near the refrigerant) may be maintained at a predetermined temperature (e.g −37 degrees Celcius) by transferring heat to the refrigerant, while the peripheral portion of the barrier absorbs heat from the adjacent unfrozen soil.

In some embodiments, the various ice column barriers may be established by different refrigerant media in the separate sets of pipes for the respective barriers. The media may be, for example, brine at −10° Celsius, Freon-13 at −80° Celsius, ammonia at −25° Celsius, or liquid nitrogen at −200 ° Celsius. In most practical situations, the virtually complete containment of contaminants is established where a continuous wall of ice is maintained at −37° Celsius or colder. At temperatures warmer than that, various contaminants may diffuse into the barriers, possibly leading to breaches.

In practice, the ice column radii may be controlled to establish multiple barriers or the multiple barriers may be merged or form a single, composite, thick-walled barrier, by appropriate control of the refrigerant medium. In order to maintain separate inner and outer barriers, it is generally necessary to space the barriers so that their respective sets of central axes are laterally displaced by at least approximately 50 feet. In this configuration, the central axes of the barrier boreholes may be considered to define a first mathematical reference surface, and the central axes of the outer boreholes define a second mathematical reference surface. With these definitions, along mathematical reference planes passing through the central axes of the barrier boreholes and the central axes of the outer boreholes, the reference planes intersect the first reference surface along a closed, continuous piecewise linear first curve, and the reference planes intersect the second reference surface along a closed, continuous piecewise linear second curve, when second curve is large than and exterior to the first curve, and those curves are laterally separated by at least approximately 50 feet. As a practical matter, refrigerant characteristics will not provide sufficient cooling of the Earth to permit the barriers to merge at that separation.

On the other hand, when it is desired to establish a composite barrier (formed by merged inner and outer barriers), the string of central axes for the respective barriers should be separated by less than approximately 35 feet. In this configuration, the central axes of the barrier boreholes may be considered to define a first mathematical reference surface, and the central axes of the outer boreholes define a second mathematical reference surface. With these definitions, along mathematical reference planes passing through the central axes of the barrier boreholes and the central axes of the outer boreholes, the reference planes intersect the first reference surface along a closed, continuous piecewise linear first curve, and the reference planes intersect the second reference surface along a closed, continuous piecewise linear second curve, when second curve is large than and exterior to the first curve, and those curves are laterally separated by less than approximately 35 feet. As a practical matter, refrigerant characteristics will generally provide sufficient cooling of the Earth to permit the barriers to merge at that separation.

With a thick walled barrier, as may be established by controlling refrigerant flow so that the ice columns from adjacent barriers merge (i.e. overlap), the resultant composite barrier may be maintained so that its central region (i.e. between the sets of inner and outer boreholes) is at a predetermined temperature, such as the optimum temperature −37° Celsius. Once this temperature is established in that central region, the refrigerant flow may be controlled so that the average barrier width remains substantially constant. For example, the flow may be intermittent so that during the "on" time the barrier tends to grow thicker and during the "off" time, the barrier tends to grow thinner due to heat absorption from Earth exterior to the composite barrier. However, during this "off" time, the region between the inner and outer boreholes tends to remain substantially at its base temperature since little heat is transferred to that region. By appropriately cycling the on-off times, the average width is held substantially constant.

In contrast, with intermittent refrigerant flow in a single barrier system, during the "on" time the barrier grows thicker, but during the "off" time the barrier not only grows thinner, but the peak (i.e. minimum temperature also rises from its most cold value. As a result, to ensure barrier integrity at the peak allowed temperature, the single barrier must be at a colder start temperature prior to the "off" cycle, leading to higher energy usage compared to a double/composite barrier configuration, and leading to an uncontrollable barrier width as thermal equilibrium is approached.

In various environments, the order of establishment at the barriers in a two (or more) barrier system may be important to maximize confinement of hazardous materials. For example, to optimize confinement in Earth formations of rock with cells or pockets, or basalt, or other forms of lava rock, it is important to first establish the inner and outer boreholes (in any order) followed first by controlling refrigerant flow in the outer boreholes to cool the adjacent rock to −37° Celsius or colder. Then, water may be added to the rock between the sets of boreholes, for example, by flooding the inner boreholes before installing the refrigerant-carrying casings, and finally refrigerant is controlled to flow in the inner boreholes to then freeze the water in the rock adjacent to those inner boreholes. With that sequence, the rock surrounding the outer boreholes is cooled so that any water-born contaminants reaching those rocks are immediately frozen in place.

The ice column barriers are extremely stable and particularly resistant to failure by fracture, such as may be caused by seismic events or Earth movement. Typically, the pressure from the overburden is effective to fuse the boundaries of any cracks that might occur; that is, the ice column barriers are "self-healing".

Breaches of integrity may also be repaired through selective variations in refrigerant flow, for example, by increasing the flow rate of refrigerant in regions where thermal increases have been detected. This additional refrigerant flow may be established in existing pipes of network 30, or in auxiliary new pipes which may be added as needed. The array of sensors may be monitored to detect such changes in temperature at various points in and around the barrier.

In the event the containment system is to be removed, the refrigerant may be replaced with a relatively high temperature medium, or removed entirely, so that the temperature at the barriers rises and the ice columns melt. To remove liquid phase water from the melted ice columns, that water may be pumped out of the injection boreholes. Of course, to assist in that removal, additional "reverse injection" boreholes may be drilled, as desired. Such "reverse-injection" boreholes may also be drilled at any time after installation (e.g. at a time when it is desired to remove the barrier).

In other forms of the invention, an outer set of "injection" boreholes might be used which is outside the barrier. Such boreholes may be instrumented to provide early and remote detection of external heat sources (such as flowing underground water).

Figure 3:
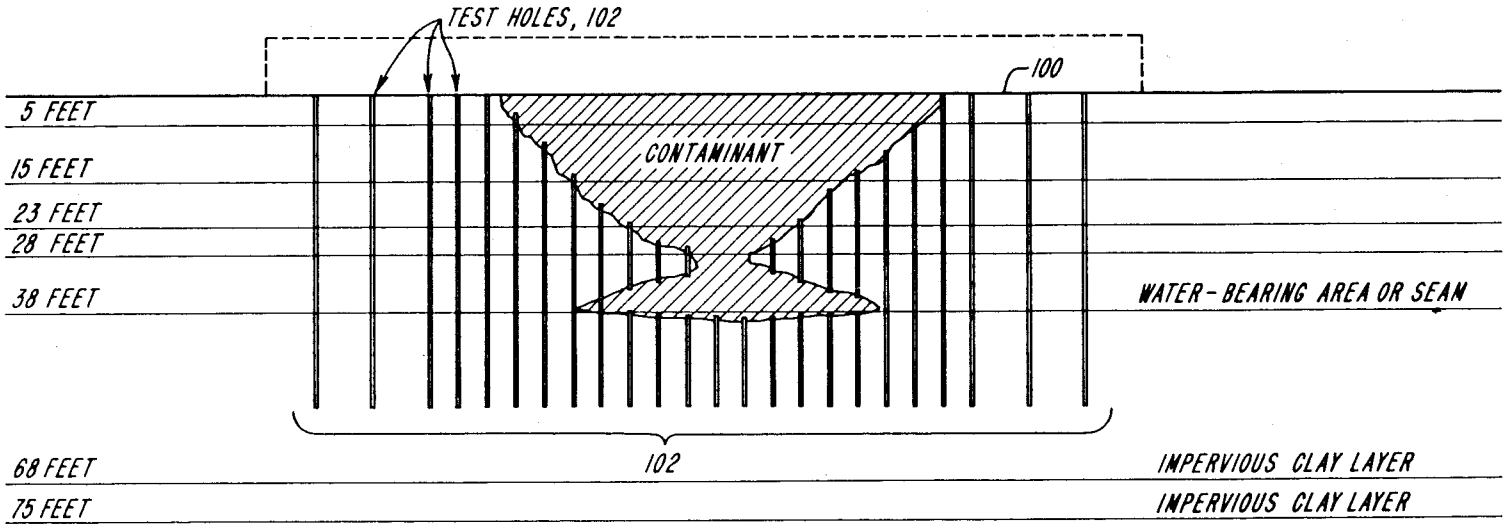
FIG. 3 shows in section an exemplary containment site overlyinq a volume containing a contaminant.

FIG. 3 shows a side view, in section, of the Earth at an exemplary, 200 foot by 200 foot rectangular containment site 100 overlying a volume bearing a contaminant. A set of vertical test boreholes 102 is shown to illustrate the means by which sub-surface data may be gathered relative to the extent of the sub-surface contaminant and sub-surface soil conditions.

Figure 4:
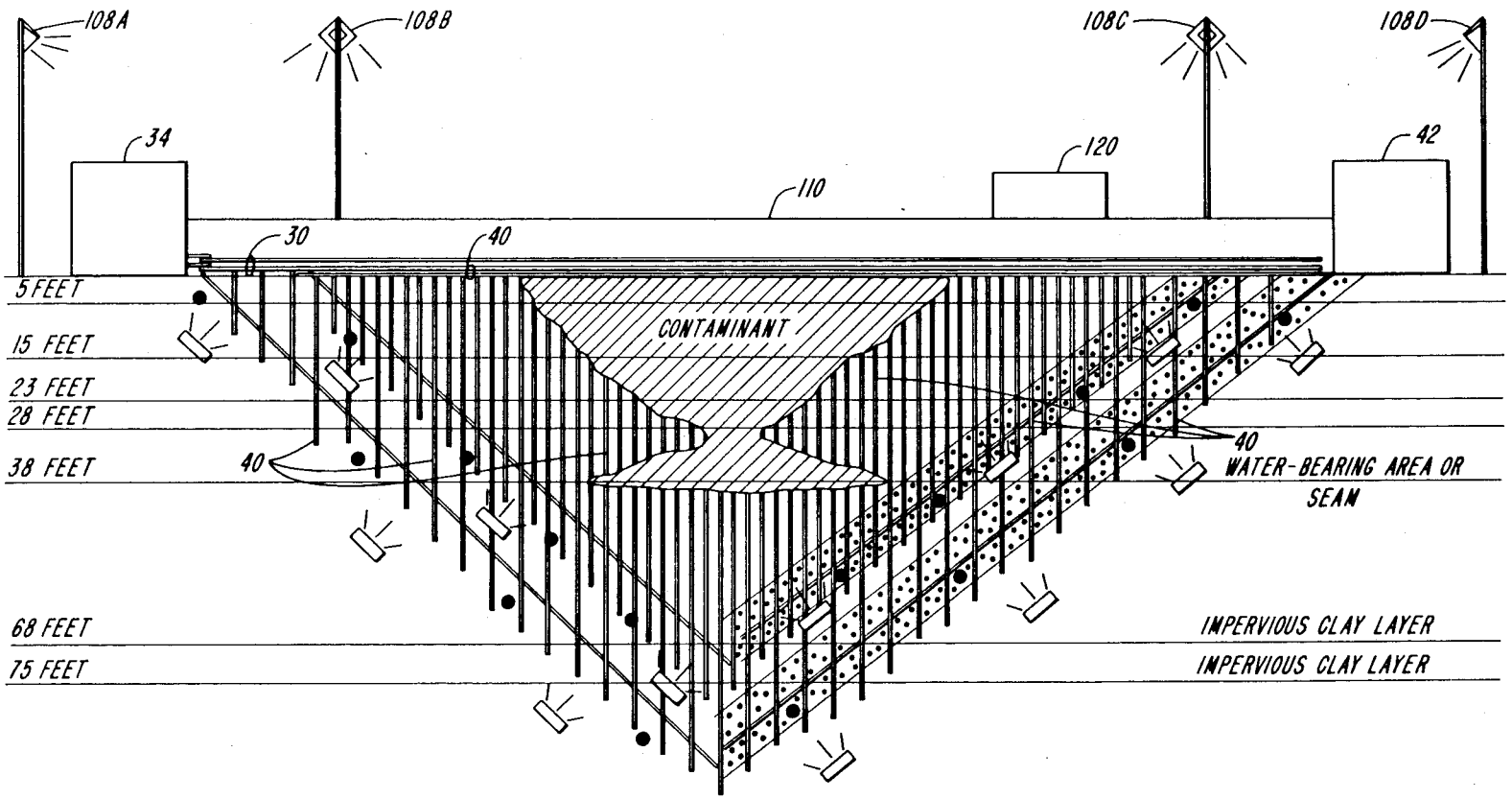
FIG. 4 shows in section an exemplary cryogenic barrier confinement system installed at the containment site of FIG. 3.

FIGS. 4 and 5 respectively show a side view, in section, and a top view, of the containment site 100 after installation of an exemplary cryogenic barrier confinement system 10 in accordance with the invention. In FIGS. 4 and 5, elements corresponding to elements in FIG. 1 are shown with the same reference designations.

The system 10 of FIGS. 4 and 5 includes a barrier network 30 having dual (inner and outer) sets of concentric, cryogenic fluid bearing pipes which are positioned in slant drilled barrier boreholes. In each pipe assembly which extends into the Earth, the diameter of the outer pipe is six inches and the diameter of the inner pipe is three inches. The lateral spacing between the inner and outer sets of barrier boreholes is approximately 25 feet. Four cryogenic pumps 34A, 34B, 34C and 34D are coupled to the network 30 in order to control the flow of refrigerant in that network. In the present configuration which is adapted to pump brine at −10° Celsius in a temperate climate, each cryogenic pump has a 500-ton (U.S. commercial) start up capacity (for freeze-down) and a 50-ton (U.S. commercial) long term capacity (for maintenance).

The system 10 also includes an injection network 40 of injection pipes, also positioned in slant drilled boreholes. Each injection pipe of network 40 extending into the Earth is a perforated, three inch diameter pipe.

As shown in FIG. 1, certain of the injection pipes (exemplified by pipe 40A) are positioned approximately mid-way between the inner and outer arrays of network 30, i.e., at points between those arrays which are expected to be the highest temperature after installation of the double ice column barrier. Such locations are positions where the barrier is most likely to indicate signs of breach. The lateral inter-pipe spacing of these injection pipes is approximately 20 feet. These pipes (type 40A) are particularly useful for injecting water into the ground between the pipes of networks 30 and 40.

Also as shown in FIG. 1, certain of the injection pipes (exemplified by pipe 40B) are adjacent and interior to selected ones of the pipes from network 30. In addition to their use for injecting water for freezing near the barrier borehole pipes, these injection pipes (type 40B) are particularly useful for the removal of ground water resulting from the melted columns during removal of the barrier. In addition, these "inner" injection boreholes may be instrumented to assist in the monitoring of barrier thickness, and to provide early warning of chemical invasion.

FIGS. 4 and 5 also show the temperature sensors as solid circles and the infra-red monitoring (or isotope monitoring) stations as rectangles. The system 10 also includes above-ground, infra-red monitors, 108A, 108B, 108C and 108D, which operate at different frequencies to provide redundant monitoring. A 10-foot thick, impervious clay cap layer 110 (with storm drains to resist erosion) is disposed over the top of the system 10. This layer 110 provides a thermal insulation barrier at the site. A solar power generating system 120 (not drawn to scale) is positioned on layer 110.

In FIG. 5, certain of the resulting overlapping ice columns (in the lower left corner) are illustrated by sets of concentric circles. In the steady state (maintenance) mode of operation in the present embodiment, each column has an outer diameter of approximately ten feet. With this configuration, an effective closed (cup-like) double barrier is established to contain migration of the containment underlying site 100. With this configuration, the contaminant tends to collect at the bottom of the cup shaped barrier system, where it may be pumped out, if desired. Also, that point of collection is the most effectively cooled portion of the confinement system, due in part to the concentration of the distal ends of the barrier pipes.

The overall operation of the containment system is preferably computer controlled in a closed loop in response to condition signals from the various sensors. In a typical installation, the heat flow conditions are monitored during the start-up mode of operation, and appropriate control algorithms are derived as a start point for the maintenance mode of operation. During such operation, adaptive control algorithms provide the desired control.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. The method for reversibly establishing a cryogenic barrier confinement system about a predetermined volume extending downward beneath a confinement surface region of the Earth, comprising the steps of:

A. establishing an array of barrier boreholes extending downward from spaced apart locations on the periphery of said confinement surface region, B. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing said barrier confinement system, and comprising the further steps of:

establishing a substantially fluid impervious outer barrier outside said predetermined volume enclosed by said ice columns, by:

C. establishing an array of outer boreholes extending downward from spaced apart locations on the outer periphery of a substantially circumferential surface region surrounding said confinement surface region of the Earth, D. establishing a flow of a refrigerant medium in said outer boreholes, whereby the water in the portions of the Earth adjacent to said outer boreholes freezes to establish ice columns extending axially along and radially about the central axes of said outer boreholes, wherein the radii of said columns and the lateral separations of said outer boreholes are selected so that adjacent columns overlap, said overlapping columns collectively establishing said outer barrier, wherein said central axes of said barrier boreholes define a first mathematical reference surface, and said central axes of said outer boreholes define a second mathematical reference surface, so that, along mathematical reference planes passing through said central axes of said barrier boreholes and said central axes of said outer boreholes, said reference planes intersect said first reference surface along a closed, continuous piecewise linear first curve, and said reference planes intersect said second reference surface along a closed, continuous piecewise linear second curve, said second curve being larger than and exterior to said first curve, wherein at least one portion of said first curve is separated from the adjacent portion of said second curve by less than approximately thirty-five feet.

2. The method of claim 1 wherein the central axes of at least one of said outer boreholes is substantially equidistant from the respective central axes of each of the nearest two barrier boreholes.

3. The method of claim 1 wherein said portion includes substantially all of said first and second curves.

4. The method of claim 1 wherein the central axes of at least a sub-set of consecutive ones of said barrier boreholes are offset in a zig-zag pattern from said periphery of said confinement surface region, and wherein the central axes of at least a sub-set of consecutive ones of said outer boreholes are offset in a zig-zag pattern from said outer periphery of said circumferential surface region surrounding said confinement surface region.

5. The method of claim 4 wherein said offsets are relatively small compared to the distance between peripheries near said sub-sets and the central axes of at least one of said outer boreholes is substantially equidistant, apart from said offsets, from the respective axes of each of the nearest two barrier boreholes.

6. The method of claim 1 wherein said steps are performed in a sequential order ACDB or CADB or ACBD or CABD.

7. The method for reversibly establishing a cryogenic barrier confinement system about a predetermined volume extending downward beneath a confinement surface region of the Earth, comprising the steps of:

A. establishing an array of barrier boreholes extending downward from spaced apart locations on the periphery of said confinement surface region, B. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing said barrier confinement system, and comprising the further steps of:

establishing a substantially fluid impervious outer barrier outside said predetermined volume enclosed by said ice columns, by:

C. establishing an array of outer boreholes extending downward from spaced apart locations on the outer periphery of a substantially circumferential surface region surrounding said confinement surface region of the Earth, D. establishing a flow of a refrigerant medium in said outer boreholes, whereby the water in the portions of the Earth adjacent to said outer boreholes freezes to establish ice columns extending axially along and radially about the central axes of said outer boreholes, wherein the radii of said columns and the lateral separations of said outer boreholes are selected so that adjacent columns overlap, said overlapping columns collectively establishing said outer barrier, wherein said central axes of said barrier boreholes define a first mathematical reference surface, and said central axes of said outer boreholes define a second mathematical reference surface, so that, along mathematical reference planes passing through said central axes of said barrier boreholes and said central axes of said outer boreholes, said reference planes intersect said first reference surface along a closed, continuous piecewise linear first curve, and said reference planes intersect said second reference surface along a closed, continuous piecewise linear second curve, said second curve being larger than and exterior to said first curve, wherein at least one portion of said first curve is separated from the adjacent portion of said second curve by at least approximately fifty feet.

8. The method of claim 7 wherein the central axis of at least one of said outer boreholes is substantially equidistant from the respective central axes of each of the nearest two barrier boreholes.

9. The method of claim 7 wherein said portion includes substantially all of said first and second curves.

10. The method of claim 7 wherein the central axes of at least a sub-set of consecutive ones of said barrier boreholes are offset in a zig-zag pattern from said periphery of said confinement surface region, and wherein the central axes of at least a sub-set of consecutive ones of said outer boreholes are offset in a zig-zag pattern from said outer periphery of said circumferential surface region surrounding said confinement surface region.

11. The method of claim 10 wherein said offsets are relatively small compared to the distance between peripheries near said sub-sets and the central axes of at least one of said outer boreholes is substantially equidistant, apart from said offsets, from the respective axes of each of the nearest two barrier boreholes.

12. The method of claim 7 wherein said steps are performed in a sequential order ACDB or CADB or ACBD or CABD.

13. The method for reversibly establishing a cryogenic barrier confinement system about a predetermined volume extending downward beneath a confinement surface region of the Earth, comprising the steps of:

A. establishing an array of barrier boreholes extending downward from spaced apart locations on the periphery of said confinement surface region, B. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing said barrier confinement system, and comprising the further steps of:

establishing a substantially fluid impervious outer barrier outside said predetermined volume enclosed by said ice columns, by:

C. establishing an array of outer boreholes extending downward from spaced apart locations on the outer periphery of a substantially circumferential surface region surrounding said confinement surface region of the Earth, D. establishing a flow of a refrigerant medium in said outer boreholes, whereby the water in the portions of the Earth adjacent to said outer boreholes freezes to establish ice columns extending axially along and radially about the central axes of said outer boreholes, wherein the radii of said columns and the lateral separations of said outer boreholes are selected so that adjacent columns overlap, said overlapping columns collectively establishing said outer barrier, wherein the central axis of at least one of said outer boreholes is substantially equidistant from the respective central axes of each of the nearest two barrier boreholes.

14. The method of claim 13 wherein said steps are performed in a sequential order ACDB or CADB or ACBD or CABD.

15. The method for reversibly establishing a cryogenic barrier confinement system about a predetermined volume extending downward beneath a confinement surface region of the Earth, comprising the steps of:

A. establishing an array of barrier boreholes extending downward from spaced apart locations on the periphery of said confinement surface region, B. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing said barrier confinement system, and comprising the further steps of:

establishing a substantially fluid impervious outer barrier outside said predetermined volume enclosed by said ice columns, by:

C. establishing an array of outer boreholes extending downward from spaced apart locations on the outer periphery of a substantially circumferential surface region surrounding said confinement surface region of the Earth, D. establishing a flow of a refrigerant medium in said outer boreholes, whereby the water in the portions of the Earth adjacent to said outer boreholes freezes to establish ice columns extending axially along and radially about the central axes of said outer boreholes, wherein the radii of said columns and the lateral separations of said outer boreholes are selected so that adjacent columns overlap, said overlapping columns collectively establishing said outer barrier, wherein the central axes of at least a sub-set of consecutive ones of said barrier boreholes are offset in a zig-zag pattern from said periphery of said confinement surface region, and wherein the central axes of at least a sub-set of consecutive ones of said outer boreholes are offset in a zig-zag pattern from said outer periphery of said circumferential surface region surrounding said confinement surface region.

16. The method of claim 15 wherein said offsets are relatively small compared to the distance between peripheries near said sub-sets and the central axes of at least one of said outer boreholes is substantially equidistant, apart from said offsets, from the respective axes of each of the nearest two barrier boreholes.

17. The method of claim 15 wherein said steps are performed in a sequential order ACDB or CADB or ACBD or CABD.

18. The method for reversibly establishing a cryogenic barrier confinement system about a predetermined volume extending downward beneath a confinement surface region of the Earth, comprising the steps of:

A. establishing an array of barrier boreholes extending downward from spaced apart locations on the periphery of said confinement surface region, B. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing said barrier confinement system, and comprising the further steps of:

wherein the central axes of at least a sub-set of consecutive ones of said barrier boreholes are offset in a zig-zag pattern from said periphery of said confinement surface region.

19. The method for reversibly establishing a cryogenic barrier confinement system about a predetermined volume extending downward beneath a confinement surface region of the Earth, comprising the steps of:

A. establishing an array of barrier boreholes extending downward from spaced apart locations on the periphery of said confinement surface region, B. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing said barrier confinement system, and comprising the further steps of:

establishing a substantially fluid impervious outer barrier outside said predetermined volume enclosed by said ice columns, by:

C. establishing an array of outer boreholes extending downward from spaced apart locations on the outer periphery of a substantially circumferential surface region surrounding said confinement surface region of the Earth, D. establishing a flow of a refrigerant medium in said outer boreholes, whereby the water in the portions of the Earth adjacent to said outer boreholes freezes to establish ice columns extending axially along and radially about the central axes of said outer boreholes, wherein the radii of said columns and the lateral separations of said outer boreholes are selected so that adjacent columns overlap, said overlapping columns collectively establishing said outer barrier, and comprising the further step of:

E. establishing said flow of refrigerant in said inner boreholes and said flow of refrigerant in said outer boreholes whereby at least some of said ice columns extending about said barrier boreholes overlap adjacent ice columns extending about said outer boreholes, said overlapping adjacent columns collectively establishing a composite barrier having a width greater than the distance between the central axes of said barrier boreholes and the central axes of said adjacent outer boreholes.

20. The method of claim 19 wherein said refrigerant flow is controlled whereby the region of Earth between the barrier and outer boreholes of said composite barrier is maintained substantially at a predetermined temperature T.

21. The method according to claim 20 wherein T equals −37° Celcius.

22. The method according to claim 20 whereby said refrigerant flow is controlled whereby average width of said composite barrier is substantially constant.

23. The method according to claim 22 wherein T equals −37° Celcius.

24. The method for reversibly establishing a cryogenic barrier confinement system about a predetermined volume extending downward beneath a surface region of the Earth, and establishing a substantially fluid impervious outer barrier outside said predetermined volume enclosed by said ice columns, comprising the sequential steps of:

A. establishing an array of barrier boreholes extending downward from spaced apart locations on the periphery of said surface region, and establishing an array of outer boreholes extending downward from spaced apart locations on the outer periphery of a substantially circumferential surface region surrounding said surface region of the Earth, B. establishing a flow of a refrigerant medium in said outer boreholes, whereby the water in the portions of the Earth adjacent to said outer boreholes freezes, and C. establishing a flow of a refrigerant medium in said barrier boreholes, whereby the water in the portions of the Earth adjacent to said barrier boreholes freezes to establish ice columns extending axially along and radially about the central axes of said barrier boreholes, wherein the position of said central axes, the radii of said columns and the lateral separations of said barrier boreholes are selected so that adjacent columns overlap, said overlapping columns collectively establishing an inner barrier of said barrier confinement system.

* * * * *